US006241114B1

(12) United States Patent
Savino et al.

(10) Patent No.: US 6,241,114 B1
(45) Date of Patent: Jun. 5, 2001

(54) CLOSURE CAP FOR DRINK CAN

(76) Inventors: Alain Savino, 14 rue au Maire, 75003 Paris; Nicolas Pernikoff, 28 rue de la foret, 78750 Mareil Marly, both of (FR)

( * ) Notice: Subject to any disclaimer, the term of this patent is extended or adjusted under 35 U.S.C. 154(b) by 0 days.

(21) Appl. No.: 09/424,577

(22) PCT Filed: May 26, 1998

(86) PCT No.: PCT/FR98/01046

§ 371 Date: Dec. 30, 1999

§ 102(e) Date: Dec. 30, 1999

(87) PCT Pub. No.: WO98/54061

PCT Pub. Date: Dec. 3, 1998

(30) Foreign Application Priority Data

| | | |
|---|---|---|
| May 26, 1997 | (FR) | 97 06381 |
| Jul. 31, 1997 | (FR) | 97 09773 |
| Oct. 14, 1997 | (FR) | 97 12832 |

(51) Int. Cl.[7] ..... B65D 43/03; B65D 51/20

(52) U.S. Cl. ..... 220/256; 220/258; 220/781; 220/906; 215/227; 215/230; 206/459.5; 206/508

(58) Field of Search ..... 220/906, 256–259, 220/781, 380, 375, 212, 521, 522; 206/503, 508, 509, 459.5; 215/228, 227, 230

(56) References Cited

U.S. PATENT DOCUMENTS

| | | | | |
|---|---|---|---|---|
| 4,154,360 | | 5/1979 | Smith . | |
| 4,782,976 | | 11/1988 | Kenyon, II . | |
| 4,917,258 | | 4/1990 | Boyd et al. . | |
| 5,139,163 | * | 8/1992 | Diaz | 220/258 |
| 5,273,176 | * | 12/1993 | Diaz | 220/258 |
| 5,312,011 | | 5/1994 | Fischer . | |
| 5,996,832 | * | 12/1999 | Nieuwoudt | 220/257 |

FOREIGN PATENT DOCUMENTS

| | | |
|---|---|---|
| 77 23 959 | 11/1977 | (DE) . |
| 0 056 906 | 8/1982 | (EP) . |
| 1 365 481 | 11/1964 | (FR) . |
| 1 397 002 | 8/1965 | (FR) . |
| 1 145 924 | 3/1969 | (GB) . |
| 2 306 456 | 5/1997 | (GB) . |
| WO 97/19001 | 5/1997 | (WO) . |

* cited by examiner

*Primary Examiner*—Nathan J. Newhouse
(74) *Attorney, Agent, or Firm*—Young & Thompson

(57) ABSTRACT

A closure cap for a cylindrical drink can comprises a top surface provided with a tear-off or collapsible opening lid surrounded by a top ring with circular cross-section projecting outside the can, a base comprising a bottom ring with circular cross-section for stacking similar cans, the bottom ring enclosing a surface curved inwards relative to the can. The cap comprises a peripheral skirt capable of being clipped on the can top ring external periphery, and a central surface bordered with a shoulder linked to the peripheral skirt top edge, the shoulder being arranged to cooperate with the inner and/or outer edge of another can bottom ring. The invention is applicable to drink cans.

18 Claims, 4 Drawing Sheets

CLOSURE CAP FOR DRINK CAN

CROSS REFERENCE TO RELATED APPLICATION

This is the 35 USC 371 national stage of International application PCT/FR98/01046 filed on May 26, 1998, which designated the United States of America.

The present invention relates to a closure cap for a metallic cylindrical can for beverages, said can comprising an upper surface provided with an opening lid that can be torn off or pushed in and surrounded by an upper ring of circular cross-section projecting outside the can, a bottom comprising a lower ring of circular section permitting nesting identical cans, said lower ring surrounding an inwardly convex surface of the can. The cans can have upper and lower rings of the same diameter or different diameters.

BACKGROUND OF THE INVENTION

The metallic cans for beverages, of steel or aluminum, have undergone important development because of the qualities they possess for the preservation and commercialization of the beverages they contain.

They have however certain drawbacks or faults which should be overcome.

The principal drawback of these cans is connected to the manner of opening them, namely the use of a detachable lid, or more recently, one that can be pushed in. This lid, which cannot be returned to its original position, does not permit consuming only a portion of the contents, then transporting the can partly empty at the risk of spilling the remaining contents. This is particularly disadvantageous in the course of a sport or recreational event, such as skiing, hiking, boating, etc. or during transport in a vehicle (automobile, motorcycle, motorbike, train, plane, etc.), such that the consumer is obliged to consume all at once all the contents of the can or to throw away the partially empty can, with in this latter case pollution of the environment by the contents.

Another drawback of metallic cans in that, although they are filled under very strict hygienic conditions, they are then subjected to atmospheric pollution in the course of their storage and transportation, such that the consumption of their contents is far from satisfactory as to the most elementary conditions of hygiene.

There was proposed in DE-U-7 723 959, a cover adapted to re-close a can with an opening that can be torn off, after partial consumption of the contents of this can. This cover has either a totally flat surface or a totally curved surface. Such a cover therefore permits re-closing the can when the latter is partially empty, but it is not possible to stack the cans for storage.

Moreover, this type of cover is proposed in the form in which it is connected to other covers by a tearing tongue. The presence of such a tearing tongue between at least two covers give rise to the risk of destruction of the cover upon their separation by tearing off and is not a very easy manipulation. A seller would have the tendency to separate the can from the cover when selling it, as often as selling it with the cover.

There is known from FR-A-1 365 481, covers for a receptacle, such as a jar of cream, of the type comprising a skirt extending to the periphery of a flat surface and permitting stacking said receptacles, the flat surface of the cover having on its upper surface a rib in relief which permits ensuring the centering of another receptacle disposed on said receptacle provided with the cover. However, such a cover does not permit a real stacking of the receptacles against particularly lateral displacement of the receptacles stacked on each other.

SUMMARY OF THE INVENTION

To this end, the cap according to the invention is characterized in that it comprises a peripheral skirt adapted to clip on the external periphery of the upper ring of a can, as well as a central surface bordered by a shoulder connected to the upper edge of said peripheral skirt, said shoulder being arranged to coact with the internal and/or external edge of the lower ring of another can.

Thus, preferably, with a cap according to the invention, said other can is laterally locked in a pile of stacked cans.

The cap according to the invention therefore permits closing the can in the course of use, without interfering with stacking by piling the cans in a package or in a refrigerator or a refrigerated case, whilst ensuring the protection of the regions of the can adapted to come into contact with the mouth of the consumer.

The protection of the can against pollution can also be improved by applying a plastic film which can be adhesive or maintained under vacuum. Such a film can be transparent, or opaque, provided with an advertising message or a decoration.

Preferably, the central surface extends at least into the plane defined by the upper edge of said shoulder or is located above said plane. The stacking of the cans is thus improved.

Preferably, the upper edge of the shoulder is inscribed at least in the plane defined by the upper edge of the peripheral skirt, which is the edge of the skirt opposed to its free edge, or is located above said plane.

According to another characteristic of the invention, the central surface can be a curved surface, hence above the upper edge of the shoulder, but it can also be inverted when desired, for example, to limit the size.

According to a first embodiment of the invention, the connection between the shoulder bordering the central surface and the upper edge of the peripheral skirt, opposite the free edge of said skirt, comprises a small flat annular collar on opposite sides of which extend the peripheral skirt and the shoulder bordering the central surface.

Thus, this embodiment permits preferably providing an annular surface on which comes to rest the lower ring of another can whilst the shoulder comes into contact against the internal edge of said lower ring of said other can.

The central surface bordered by the shoulder can be curved and thus located above the plane defined by the upper edge of the shoulder. This curved surface can be used to nest below the lower curved surface of another can, which promotes lateral locking of the stacked cans and the last can of the stack can have a cap whose central surface is reversed to limit the size of said can as to its height.

According to a modification, the central surface is curved and extends above the plane defined by the upper edge of the shoulder, this curved surface being thus reversed such that the shoulder forms a crown which can be disposed against the external peripheral edge of the lower crown of another can.

Preferably, the cap according to the invention thus comprises a protection constituted by the central surface bordered by the shoulder, said projection being arranged to be received within the lower crown of another can or to surround said lower crown.

According to a second embodiment, the connection between the shoulder bordering the central surface and the upper edge of the peripheral skirt comprises a shoulder which is concentric and opposed to the shoulder bordering the central surface, said shoulders defining a groove adjacent the peripheral skirt.

The capsule according to this embodiment is thus provided with a groove in which can nest the lower crown of another can. And, even if this groove is less steep, the two opposed shoulders will lock the lower crown of said other can such that said other can is prevented from moving laterally relative to the can with which it is nested.

Preferably, the central surface is flat and inscribed in the plane defined by the upper edge of the shoulder bordering said central surface such that there is obtained a nesting by reliable interfitting with the help of a cap having a limited height.

According to a modification of this embodiment, the central surface, the shoulder bordering said central surface and the shoulder which is opposite and concentric, defining between them the groove adjacent the peripheral skirt, are constituted, at the time of nesting the cans, by the deformation of the bottom of the cap, under the effect of pressure exerted upon engagement of the lower ring of a can within the upper ring of the can carrying the cap.

Thus, the cap comprises a peripheral skirt adapted to clip over the external periphery of the upper ring and delimiting a surface, preferably flat, forming the bottom of the cap covering the upper surface of the can, the bottom being constituted by a deformable material such that, in the course of stacking, the lower ring of another can of a diameter less than the diameter of the upper ring of the can comprising the cap, comes to engage concentrically within the upper ring of the can comprising the cap, said lower ring deforming, under the exerted pressure, the bottom of the cap which forms a central surface which is disposed within the lower ring, bordered by the shoulder, and a groove adjacent to the peripheral skirt.

Preferably, the capsule thus comprises also an internal peripheral skirt concentric to the peripheral skirt of said cap and which extends along the internal periphery of the upper ring of the can. There is thus obtained better positioning of the cap on said can.

In this way, there is used the play which exists in certain cans, between the external diameter of the lower ring and the internal diameter of the upper ring, to form the shoulder and the central surface of the cap.

Another drawback of the closure is its unsightly appearance. To overcome this drawback, the cap can be opaque.

Another advantage of the cap according to the invention is that it can serve as a decorative or informative or promotional and/or advertising support. To this end, it can be provided that the cap is externally or internally coated with a decoration which can be printed, transferred or glued on said external surface. Moreover, it is also possible to hide the closure system even if the cap is transparent or translucent.

Furthermore, the cap can serve to retain an advertising and/or promotional message, such as printing, a sample, an object, etc. within the upper ring.

To facilitate emplacement and removal of the cap according to the invention, it can be provided that, in a manner known per se, it comprises at least one peripheral external projection and/or at least one radial tongue.

The capsule can also be connected to the can, for example by hinging on a ring fixed to the can, preferably of a single piece with the cap.

So as to promote reliable clipping of the peripheral skirt of the cap on said upper ring, said peripheral skirt can have, projecting inwardly, a continuous or interrupted return such that, during emplacement of the cap on the can, said return can be disposed below the edge of the upper ring, thereby ensuring snapping on of the peripheral skirt.

According to one embodiment, the return is constituted by the truncated shape of the peripheral skirt, the large base of the truncated cone corresponding to the diameter of the cap and the small base of the truncated cone corresponding to the free end of the peripheral skirt being itself disposed below the edge of the upper ring of the can.

BRIEF DESCRIPTION OF THE DRAWINGS

The invention will be better understood from a reading of the following description of embodiments, with reference to the accompanying drawings, in which.

DESCRIPTION OF THE PREFERRED EMBODIMENTS

Figure 1:
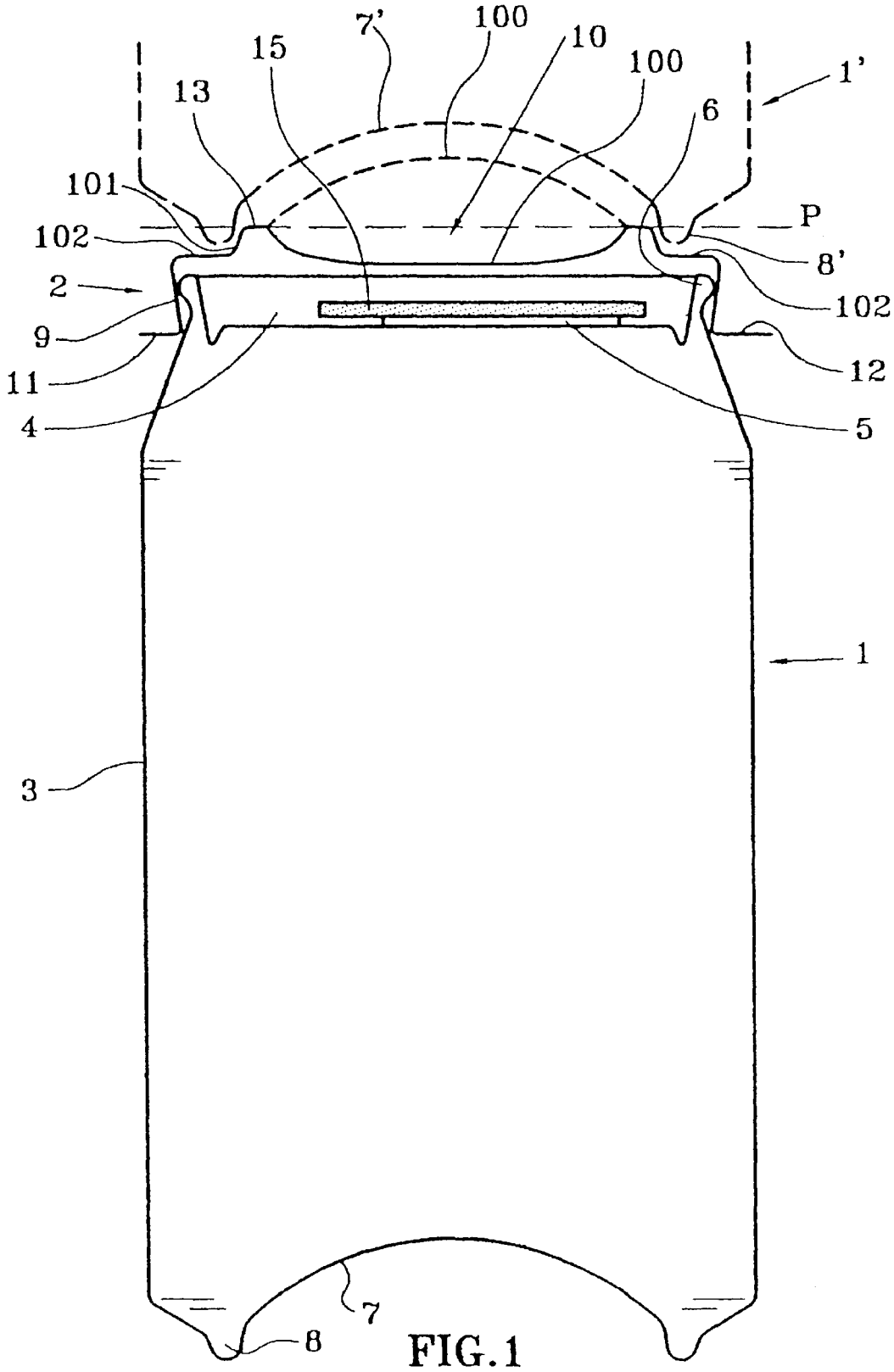
FIG. 1 is a schematic view in vertical cross-section of a cap according to a first embodiment, mounted on a metallic can.

The cans 1 on which are adapted to be mounted the caps 2 according to the invention, are metal cans with peripheral cylindrical walls 3 whose upper surface comprises a central flat circular surface 4 in the illustrated embodiment, provided with a lid 5 that can be torn off or pushed in. The central surface 4 is surrounded by an upper ring 6 of circular shape. The bottom of the can 1 comprises a central surface 7 which is inwardly convex, on the can, and surrounded by a lower ring 8 whose diameter, in the illustrated embodiment, is slightly less than that of the upper ring 6, so as to permit nesting of the cans in each other with lateral retention.

The cap 2 according to the invention is constituted by a piece of injected or thermoformed plastic material comprising a peripheral skirt 9 surrounding a body 10 or bottom of the cap.

The skirt 9 is slightly truncated conical to form a return permitting continuous or interrupted clipping on the edge of the upper ring 6 of the can 1 and can be prolonged by a radial small collar 11 facilitating snapping off the cap.

There can also be provided one or several small tongues 12 to assist in snapping and unsnapping the cap.

The body 10 or bottom of the cap 2 comprises a central surface 100 bordered by a shoulder 101 connected to the peripheral skirt 9. This shoulder 101 is concentric to the peripheral skirt and slightly truncated conical.

The connection between said shoulder 101 and the upper edge of the peripheral skirt 9 is constituted by a small flat annular collar 102 on opposite sides of which extend the peripheral skirt 9 and the shoulder 101, substantially perpendicular to said small collar 102.

During emplacement of another can 1' on the can 1, the lower ring 8' of said can 1' comes to rest on said small collar 102 whilst the shoulder 101 remains against the inner edge of said ring 8'.

The central surface 100, which, in the example, is curved (shown in dotted lines) and located above the plane P defined by the upper edge of the shoulder 101, is lodged below the central curved surface 7' of the other can 1'.

There is thus ensured a lateral locking of the cans 1, 1' stacked on each other.

Because of the plastic nature of the material constituting the cap 2, the central curved surface 100 can be inverted to occupy the retracted position shown in full line so as to limit the size of the cap 2 as to height, for example for the last can in the stack.

If the surface 100 is flat, it constitutes with the shoulder 101 a central projection adapted to be disposed in the central curved surface 7' of the can 1'.

According to a modification of this embodiment, the central curved surface 100 is inverted and the shoulder 101 thus forms a ring 13 on the capsule 2 which can lodge within the lower ring 8' of an identical can 1'.

The ring 13 thus formed can also have a diameter substantially equal to that of the upper ring of the can so as to surround the lower ring 8' of the can 1'.

In the case in which the lower ring 8 and upper ring 6 of the cans are the same diameter or when the lower ring 8 is larger than the upper ring 6, the ring 13 of the cap will of course have a diameter greater than that of the lower ring. As a function of the diameter of the lower ring 8, the ring 13 of the cap 2 will have a suitable diameter to surround the latter or to be disposed in it.

In the curved position, shown in dotted lines, of the central surface 100, a body or an object can be maintained by said central curved surface 100. The positioning of this curved surface 100 (shown in dotted lines) permits disposing a relatively large object therein whilst improving the lateral grip of the cans 1, 1' when they are stacked.

Figure 2:
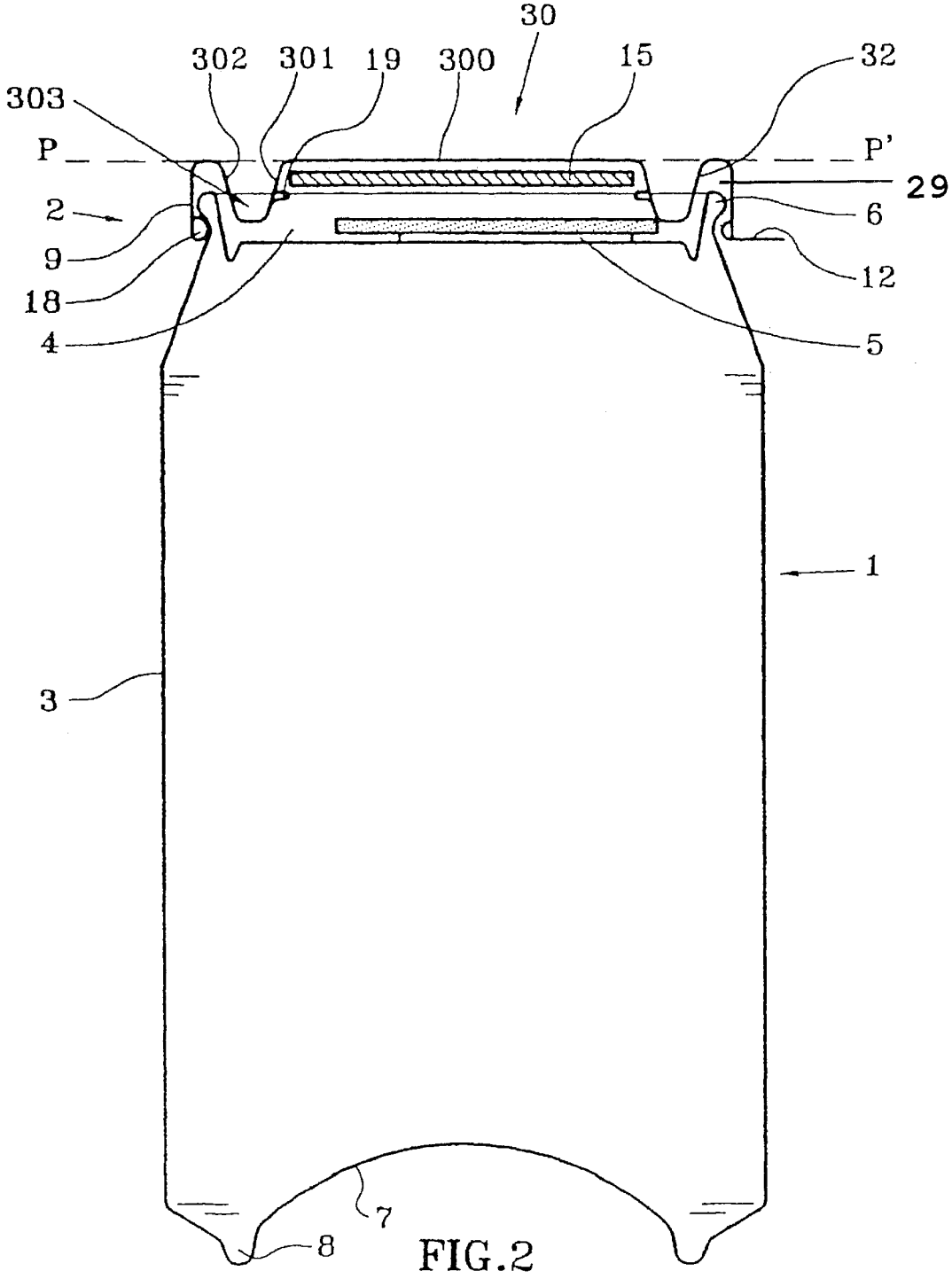
FIG. 2 is a view similar to FIG. 1 of a second embodiment of the invention.

In the embodiment shown in FIG. 2, the cap 2 comprises a peripheral skirt 9 and a cap body or bottom 30. The body 30 of cap 2 has a central surface 300 bordered by a shoulder 301 connected to the peripheral skirt.

The connection of said shoulder 301 with the upper edge of the peripheral skirt 9 comprises a concentric shoulder 302 opposite the shoulder 301 and defining with the latter a groove 303 adjacent the peripheral skirt 9. This groove 303 is suitable to receive the lower ring 8' of another can 1'.

The shoulders 301 and 302 are defined by substantially truncated conical walls concentric to the peripheral skirt 9.

Preferably, the central surface 300 is inscribed in the plane P defined by the upper edge of the shoulder 301 and, preferably, said upper edge of the shoulder 301 is inscribed at least within the plane P' defined by the upper edge of the peripheral skirt 9 or above said plane P'. The planes P and P' are in this case coincident.

The peripheral skirt 9 comprises on its lower edge, a return constituted by an inwardly extending roll 18 such that, during emplacement of the cap on the can 1, said roll 18 comes to rest below the edge of the upper ring 6.

An advertising and/or promotional support, such as printing 15 or a sample or an object, can be enclosed within the upper ring 6 of the can 1 and retained by the cap 2.

When a printing 15 is emplaced, it is advantageous to provide that the cap 2 comprise a peripheral retaining lip 19 for printed material 15 in the form of a disc, for example, arranged to permit freeing said printed material 15 by pressure on the upper surface of the cap 2.

In FIG. 2, this peripheral retaining lip 19 is provided at the level of the inner surface of the shoulder 301 and permits retaining the advertising disc 15.

Figure 3:
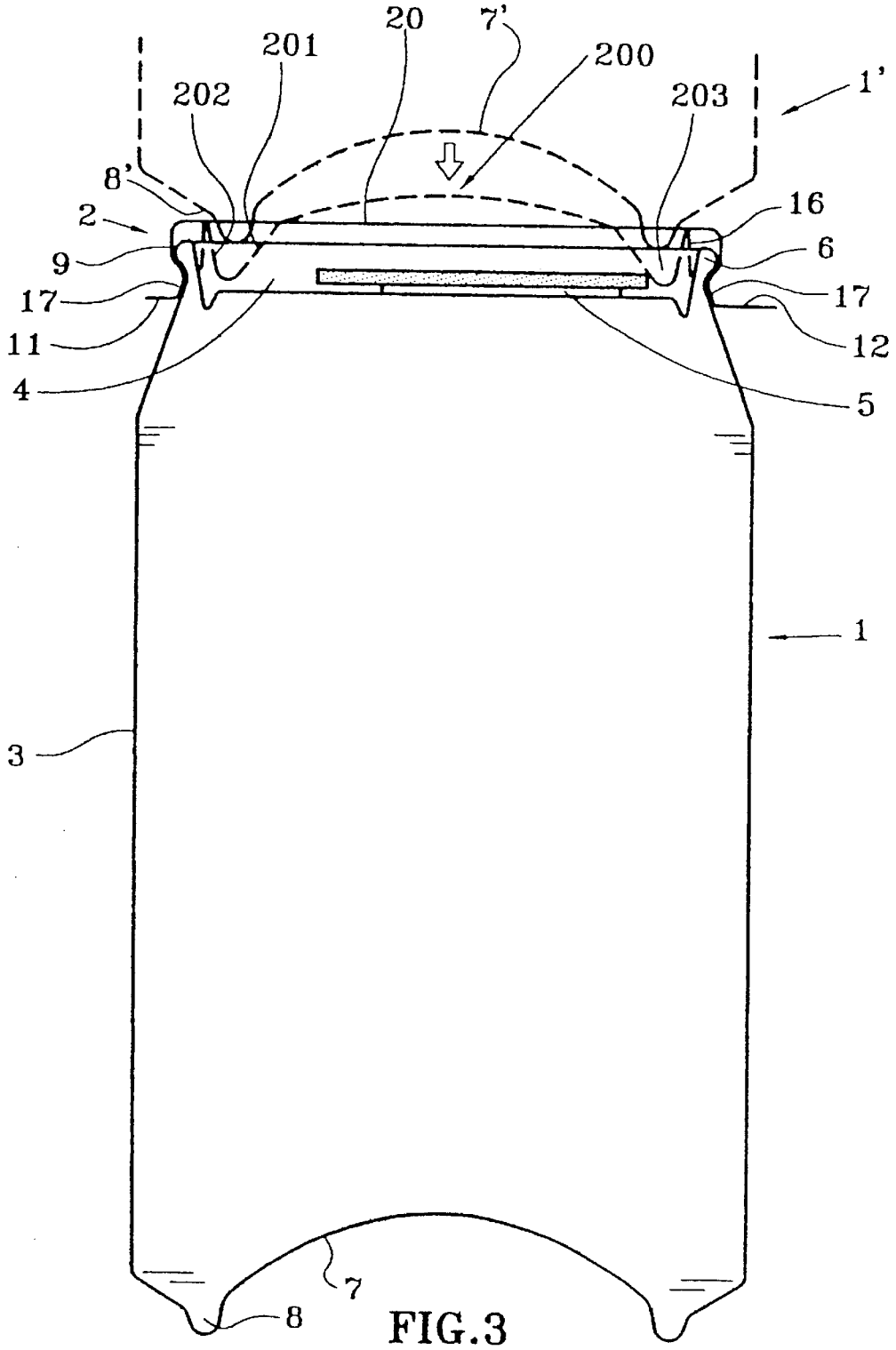
FIG. 3 is a view analogous to FIG. 1, for a modification of the second embodiment.

FIG. 3 shows a modification of the second embodiment of a cap 2 according to the invention, in which the shoulders defining the central surface and the groove adjacent to the peripheral skirt are obtained by stacking by nesting the cans.

Thus, the cap 2 comprises a peripheral skirt 9 surrounding a body or bottom of the cap which is constituted here by a flat surface 20 (shown in full line).

The central surface 200, the shoulder 201 bordering said central surface 200 and the second shoulder 202 defining with the shoulder 201 the groove 203 adjacent the peripheral skirt 9, are finally defined in the course of stacking by nesting the cans, at least the material constituting the bottom of the cap 2 being deformable.

This embodiment is usable in the case of a can 1 in which the lower ring 8 is of an external diameter less than the internal diameter of the upper ring 6 so as to permit the stacking of the cans. In this way, when one can 1' is stacked on a can 1 provided with the cap 2 having a flat deformable surface 20, the pressure exerted in the course of stacking deforms said flat surface 20 which is pressed along the internal wall of the upper ring 6 of the can 1 and which thus forms the central surface 200 bordered by a shoulder 201 and defining with the second shoulder 202 a groove 203 adjacent the peripheral skirt 9.

Preferably, the cap 2 moreover comprises an internal skirt 16 concentric to the peripheral skirt 9 and adapted to extend along the internal wall of the upper ring 6 during emplacement of the cap 2 on the can 1, said skirts 9 and 16 not undergoing deformation in the course of stacking. In particular, the skirts can be made of the same material as the flat surface 20 but thicker or else of another non-deformable material.

The cap 2 can comprise a straight peripheral skirt 9 having projecting inwardly a return 17, continuous or interrupted, adapted to be disposed below the edge of the upper ring 6. The clipping of the cap 2 is thus perfectly guaranteed.

As is indicated above, the cap 2 according to the invention permits re-closing the can 1, after opening the lid 5, and consuming a portion of the contents of the can, without interfering with stacking of said cans 1, 1', etc. at the outset.

The cap 2 can be opaque, in which case it improves the appearance of the can 1 by masking the lid 5.

The opaque, transparent or translucent cap 2 can be external or internally coated with a decoration which can for example be printed, transferred or glued on, so as to overcome the difficulty of applying such a decoration directly on the central surface 4, provided with the lid 5, of the upper surface of the can 1. Such a decoration can be for promotion, publicity, information and/or simply decoration.

Usually, the cap according to the invention, when it is in place on an open can, ensures sufficient sealing, because of the clipping of the skirt over the upper ring of the can, to avoid loss of liquid.

In the case in which the contained liquid is a carbonated beverage, however, the gas which escapes has the tendency to raise the cap when leaving.

To overcome this drawback, it can be provided that the cap 2 has at least one radial gas escape passage 29, preferably formed by a groove facing the front surface of the upper ring of the can 6.

Figure 4B:
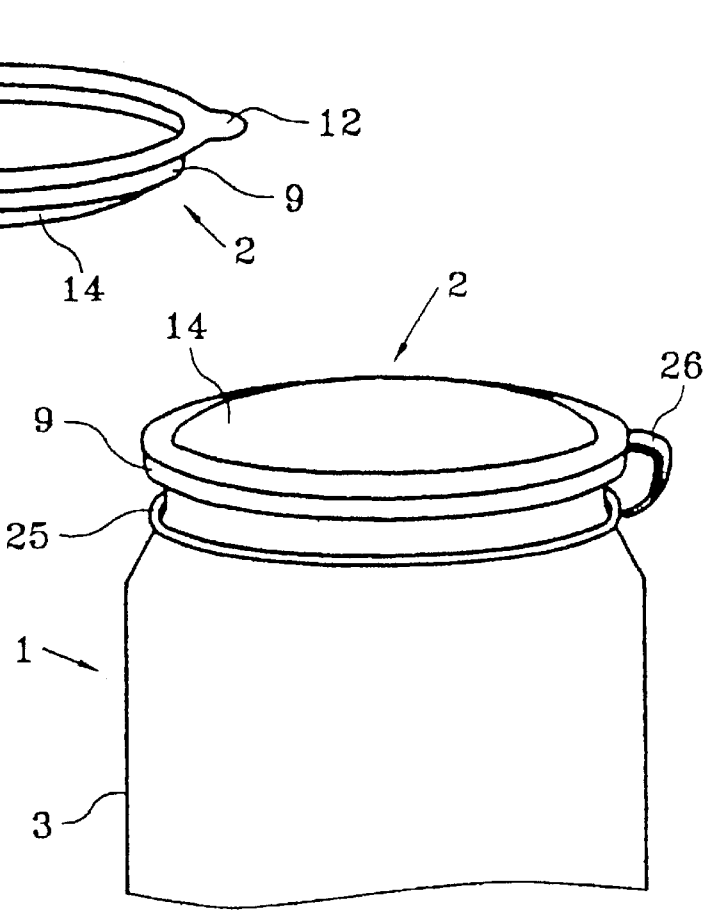
FIG. 4 is a schematic perspective view of a modified embodiment of the cap according to the invention.
Figure 4A:
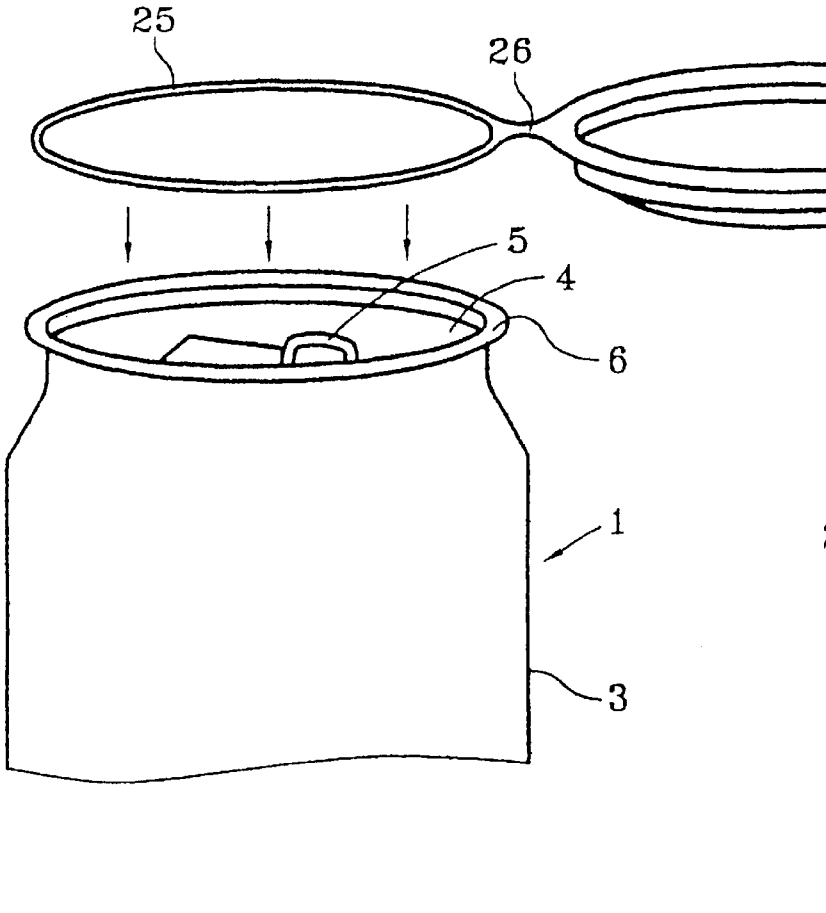

In FIGS. 4*a* and 4*b* is shown a modified embodiment of a cap 2 according to the invention. The cap 2 is here connected to the can 1, preferably hinged by a tongue 26 on a ring 25 fixed to said can 1. This ring 25 is preferably made of a single piece with the cap 2. Preferably, the internal diameter of the ring 25 corresponds to the diameter of the can 1 below the upper ring 6 and it is emplaced below said upper ring 6.

Once the ring 25 is in place, the cap 2 is folded down over the upper portion of the can and the peripheral skirt 9 of said cap 2 clips over the external periphery of the upper ring of the can 1. There is thus obtained a cap 2 which can always permit stacking of the can and which forms a cover for said can when it is open whilst offering better hygiene. Because the cap 2 is attached to the can by the ring 25, there is no risk of it being lost or dirtied.

What is claimed is:

1. A closure cap for a cylindrical metal can for beverages, said can comprising an upper surface provided with an opening lid that can be torn off or pushed in and surrounded by an upper ring with a circular cross-section projecting outwardly of the can, a bottom comprising a lower ring of circular cross-section permitting stacking of identical cans, said lower ring surrounding an inwardly curved surface of the can;

the cap comprising a peripheral skirt adapted to clip over the external periphery of the upper ring of a can; a central surface bordered by a shoulder connected to the upper edge of said peripheral skirt; and a peripheral lip for retaining an advertising support; said peripheral lip being structured and arranged to permit freeing said support by pressure on an upper surface of the cap; and said shoulder being arranged to coact with at least one of an internal edge and an external edge of the lower ring of another can.

2. The cap according to claim 1, wherein the central surface extends at least in a plane defined by an upper edge of said shoulder or is located above said plane.

3. The cap according to claim 1, wherein an upper edge of the shoulder is inscribed at least in a plane defined by the upper edge of the peripheral skirt or is located above said plane.

4. The cap according to claim 1, wherein the connection between the shoulder bordering the central surface and the upper edge of the peripheral skirt comprises a small flat annular collar on opposite sides of which extend said shoulder and said peripheral skirt.

5. The cap according to claim 1, wherein the connection between the shoulder bordering the central surface and the upper edge of the peripheral skirt comprises a second shoulder concentric with and opposed to said shoulder bordering the central surface; said shoulders defining a groove adjacent the peripheral skirt.

6. The cap according to claim 5, wherein the central surface, the shoulder bordering said central surface, and the opposite and concentric second shoulder defining between them the groove adjacent to the peripheral skirt are constituted, at the time of stacking the cans by the deformation of the bottom of the cap, constituted of a deformable material, under the influence of pressure exerted during engagement of the upper ring of one can with the upper ring of the can bearing the cap.

7. The cap according to claim 1, wherein the central surface is an invertible curved surface.

8. The cap according to claim 1, further comprising at least one of a peripheral external projection and at least one radial tongue.

9. The cap according to claim 1, wherein said cap is connected to a can by articulation on a ring fixed to the can.

10. The cap according to claim 1, wherein the peripheral skirt has projecting inwardly, a continuous or interrupted return adapted to be disposed below an edge of the upper ring during emplacement of the cap on a can.

11. The cap according to claim 10, wherein the return comprises a truncated conical shape of the peripheral skirt, the large base of the truncated cone corresponding to the diameter of the cap and the small base of the truncated cone corresponding to the free end of the peripheral skirt.

12. The cap according to claim 1, further comprising at least one radial passage for the escape of gas.

13. The cap according to claim 12, wherein said passage is formed by a groove facing the front surface of the upper ring of the can.

14. The cap according to claim 1, wherein the cap is opaque.

15. The cap according to claim 1, wherein the cap is transparent or translucent.

16. The cap according to claim 1, wherein at least one of the external and internal surfaces of the cap is coated with a decoration adapted to be printed, transferred or glued onto said surface.

17. The cap according to claim 1, wherein the cap is comprised of a piece of injected or thermoformed plastic material.

18. Method of holding an advertising support onto a can, which comprises:

providing a can having an upper surface provided with an opening lid that can be torn off or pushed in and surrounded by an upper ring with a circular cross-section projecting outwardly of the can, a bottom comprising a lower ring of circular cross-section permitting stacking of identical cans; said lower ring surrounding an inwardly curved surface of the can;

providing a cap having a peripheral skirt adapted to clip over the external periphery of the upper ring of a can; a central surface bordered by a shoulder connected to the upper edge of said peripheral skirt; and a peripheral lip for retaining an advertising support; said peripheral lip being structured and arranged to permit freeing said support by pressure on an upper surface of the cap; said shoulder being arranged to coact with at least one of an internal edge and an external edge of the lowering of another can;

placing the advertising support onto the upper surface of the lid within the upper ring of the can; and retaining said advertising support within said upper ring by clipping said cap over the external periphery of the upper ring of the can.

* * * * *